US009637266B2

(12) United States Patent
Itano

(10) Patent No.: US 9,637,266 B2
(45) Date of Patent: May 2, 2017

(54) PACKAGING BOX INCLUDING A BUFFERING MEMBER DISPOSED AROUND A PACKAGED ARTICLE

(71) Applicant: KYOCERA Document Solutions Inc., Osaka (JP)

(72) Inventor: Atsushi Itano, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/883,867

(22) Filed: Oct. 15, 2015

(65) Prior Publication Data

US 2016/0107789 A1 Apr. 21, 2016

(30) Foreign Application Priority Data

Oct. 17, 2014 (JP) ..... 2014-212621

(51) Int. Cl.

| | |
|---|---|
| ***B65D 5/50*** | (2006.01) |
| ***B65D 19/06*** | (2006.01) |
| ***B65D 5/32*** | (2006.01) |
| ***B65D 5/68*** | (2006.01) |

(52) U.S. Cl.

CPC ..... *B65D 5/5028* (2013.01); *B65D 5/32* (2013.01); *B65D 5/5035* (2013.01); *B65D 5/68* (2013.01); *B65D 19/06* (2013.01); *B65D 2519/00159* (2013.01); *B65D 2519/00194* (2013.01);

(Continued)

(58) Field of Classification Search

CPC ..... B65D 5/32; B65D 5/50; B65D 5/5027; B65D 5/5028; B65D 5/5033; B65D 5/5035; B65D 5/68; B65D 19/06; B65D 19/20; B65D 81/054; B65D 81/056; B65D 2519/00159; B65D 2519/00194; B65D 2519/00333; B65D 2519/00711; B65D 2585/6892

USPC ..... 206/386, 586, 598, 600; 220/4.21, 4.28, 220/4.33, 4.34

See application file for complete search history.

(56) References Cited

U.S. PATENT DOCUMENTS 5,823,349 A * 10/1998 Bridges ..... B65D 19/20 206/386
7,896,159 B2 * 3/2011 Goda ..... B65D 19/20 206/386

(Continued)

FOREIGN PATENT DOCUMENTS

JP 3080652 U * 10/2001 ..... B65D 5/5033
JP 2008-179367 A 8/2008

*Primary Examiner* — Bryon Gehman

(74) *Attorney, Agent, or Firm* — Studebaker & Brackett PC

(57) ABSTRACT

A packaging box includes a bottom case, a covering case and a buffering member. The buffering member is formed with a protruding piece protruded on the bottom plate in a direction of the side plate of the bottom case. By causing the protruding piece to abut against the side plate of the bottom case, a gap into which the side plate of the covering case can be inserted is formed with respect to the side plate of the bottom case. The bottom plate is formed with a space in which the protruding piece can be housed, at a position corresponding to the protruding piece. When the side plate of the covering case is inserted inside the side plate of the bottom case, the protruding piece of the buffering member is pressed by the side plate of the covering case and then folded to be housed in the space.

5 Claims, 6 Drawing Sheets

(52) U.S. Cl.
CPC ..... *B65D 2519/00333* (2013.01); *B65D 2519/00711* (2013.01); *B65D 2585/6892* (2013.01)

(56) References Cited

U.S. PATENT DOCUMENTS 8,118,188 B2 * 2/2012 Xin ..... B65D 5/4283 220/324
8,240,469 B2 * 8/2012 Goda ..... B65D 19/20 206/386
8,256,615 B2 * 9/2012 Goda ..... B65D 19/06 206/386
9,327,869 B2 * 5/2016 Nakamura ..... B65D 19/20

* cited by examiner

PACKAGING BOX INCLUDING A BUFFERING MEMBER DISPOSED AROUND A PACKAGED ARTICLE

INCORPORATION BY REFERENCE

This application is based on and claims the benefit of priority from Japanese Patent application No. 2014-212621 filed on Oct. 17, 2014, the entire contents of which are incorporated herein by reference.

BACKGROUND

The present disclosure relates to a packaging box configured to protecting a packaged article during transportation or storage.

As a packaging box configured to package a packaged article, such as an image forming apparatus including a printer, a copying machine, a facsimile or a multifunction peripheral, a separate type packaging box is sometimes used. The separate type packaging box has a bottom case on which the packaged article is to be placed and a covering case to be covered on the bottom case, and is configured bypassing a joint through coupling holes formed in the respective case to couple these two cases to each other. In the separate type packaging box, the covering case is inserted into the bottom case so that the coupling holes formed in the respective cases are easily aligned with each other.

When a buffering member is interposed between such a separate type packaging box and the packaged article, the buffering member needs to be disposed inside from a side plate of the bottom case by a gap of a thickness of the side plate of the covering case. In order to position the buffering member inside of the bottom case in this manner, the buffering member is formed with a protruding piece extended in a horizontal direction. By abutting the protruding piece against the side plate of the bottom case, the buffering member can be thereby disposed inside with a gap of a length of the protruding piece from the side plate of the bottom case.

However, if such a protruding piece is formed on the buffering member, when the covering case is inserted into the bottom case, the side plate of the covering case rides on the protruding piece and the positions of the coupling holes of the respective cases are shifted to each other. Thus, as shown in FIG. 6A, in the separate type packaging box in which a side plate 123 of a covering case 120 is inserted inside a side plate 113 of a bottom case 110, the side plate 123 of the covering case 120 may be formed with a notch 125 into which a protruding piece 141 of a buffering member 140 is fitted so that a coupling hole 114 of the bottom case 110 and a coupling hole 124 of the covering case 120 overlap each other.

However, in the packaging box in which the notch 125 is formed in the covering case 120, the processing for forming the notch 125 in the covering case 120 is required or a compression strength of the covering case 120 lowers at a portion where the notch 125 is formed. Alternatively, as shown in FIG. 6B, the side plate 123 of the covering case 120 may be placed on the protruding piece 141 and then press it downward, and then the bottom case 110 and the covering case 120 may be coupled to each other with the protruding piece 141 compressed. In this instance, since the side plate 123 of the covering case 120 is applied with a load intensively at a portion where presses the protruding piece 141, a compression strength of the covering case 120 weakens at the portion. Also, if the covering case 120 while riding on the compressed protruding piece 141 is coupled to the bottom case 110, since the covering case 120 is lifted from the bottom case 110 by a thickness of the compressed protruding piece 141, a posture of the covering case 120 becomes unstable or the positions of the coupling hole 114 of the bottom case 110 and the coupling hole 124 of the covering case 120 are shifted to each other, which make it difficult to couple the cases.

SUMMARY

In accordance with an embodiment of the present disclosure, a packaging box includes a bottom case, a covering case and a buffering member. The bottom case has a bottom plate and a side plate erected from a peripheral edge of the bottom plate. A first coupling part is formed in the side plate. The covering case has a top plate and a side plate suspended from a peripheral edge of the top plate. A second coupling part is formed at a position corresponding to the first coupling part of the side plate. The buffering member is disposed around a packaged article on the bottom plate. The packaging box is configured by inserting the side plate of the covering case inside the side plate of the bottom case and then coupling the first coupling part and the second coupling part to each other. The buffering member is formed with a protruding piece. The protruding piece is protruded on the bottom plate in a direction of the side plate of the bottom case. By causing the protruding piece to abut against the side plate of the bottom case, a gap into which the side plate of the covering case can be inserted is formed with respect to the side plate of the bottom case. The bottom plate is formed with a space in which the protruding piece can be housed, at a position corresponding to the protruding piece of the buffering member. When the side plate of the covering case is inserted inside the side plate of the bottom case, the protruding piece of the buffering member is pressed by the side plate of the covering case and then folded to be housed in the space.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, a packaging box according to an embodiment of the present disclosure will be described with reference to the drawings.

Figure 1:
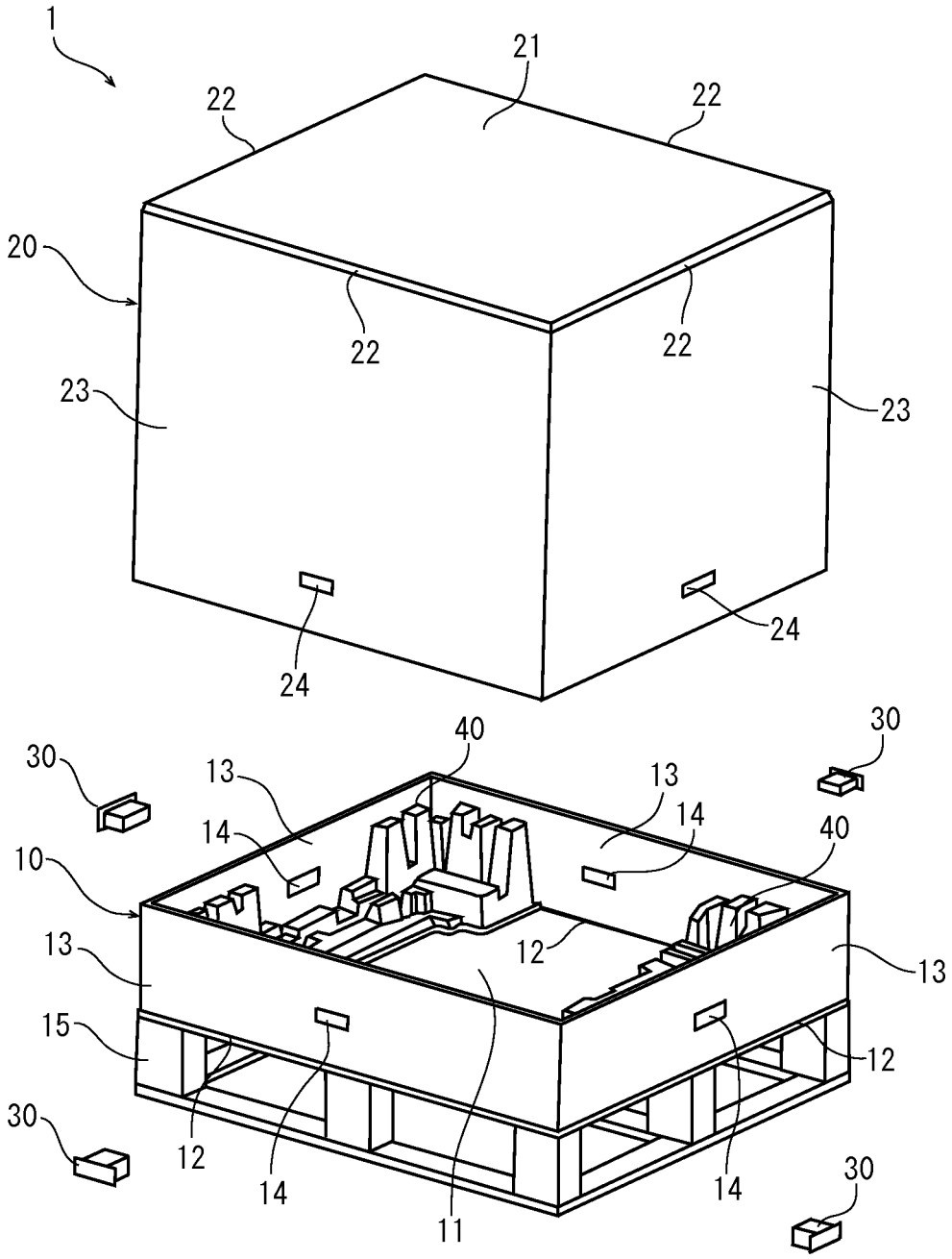
FIG. 1 is a perspective view showing a packaging box according to an embodiment of the present disclosure.
Figure 2A:
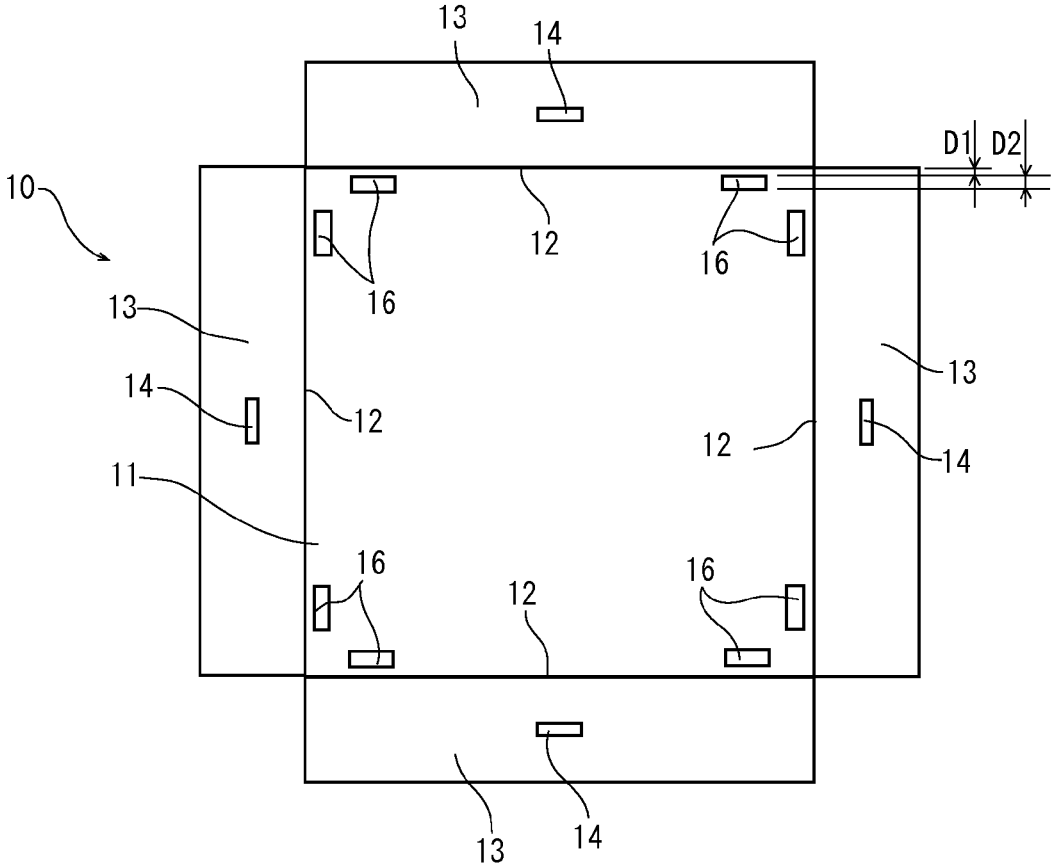
FIG. 2A is an exploded view showing a bottom case of a packaging box according to a first embodiment of the present disclosure.
Figure 2B:
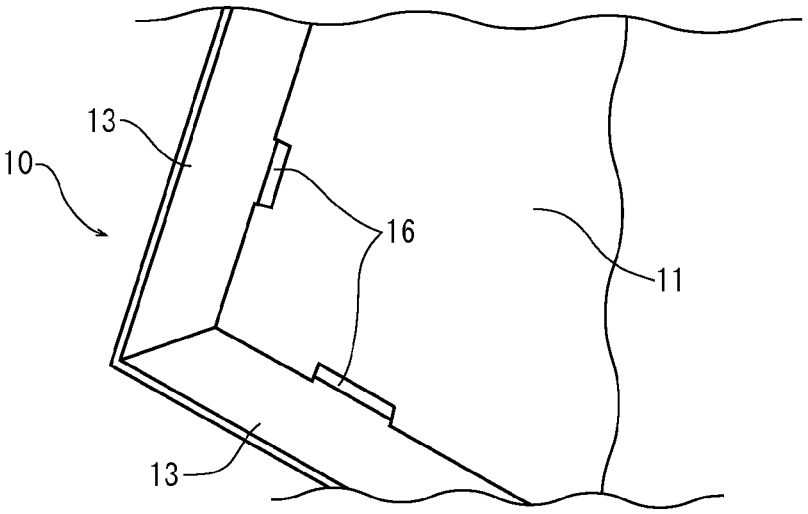
FIG. 2B is a perspective view showing a corner of the bottom case of the packaging box viewed from the upper side, in the packaging box according to the first embodiment of the present disclosure.

A packaging box according to a first embodiment of the present disclosure will be described with reference to FIG. 1 to FIG. 3. FIG. 1 is a perspective view showing the packaging box; FIG. 2A and FIG. 2B are views each showing a bottom case of the packaging box; and FIG. 3 is a view showing a buffering member installed in the bottom case.

As shown in FIG. 1, a packaging box 1 has: a bottom case 10; a covering case 20 inserted inside the bottom case 10; a joint 30 to couple the bottom case 10 and the covering case 20 to each other; and a pair of buffering members 40 installed in the bottom case 10. The bottom case 10 and the covering case 20 each are made of a high strength packaging material, such as a cardboard, and the buffering member 40 is made of pulp mold, for example. A packaged article is a multifunction peripheral formed in a substantially cubic shape, for example.

The bottom case 10 has: a substantially square-shaped bottom plate 11; and horizontally long rectangular side plates 13 which are erected from peripheral edges 12 of the bottom plate 11. At a substantial center of the side plate 13, a coupling hole 14 (a first coupling part) configured to couple the bottom case 10 with the covering case 20 is opened. Also, on an under face of the bottom plate 11, a pallet 15 engaging with an engaging part of a forklift when being conveyed by the forklift or the like is provided. Incidentally, the pallet 15 may not be provided.

As shown in FIG. 2A and FIG. 2B, at four corners of the bottom plate 11, an elongated hole 16 in parallel with the peripheral edge 12 is opened slightly inside from each of the adjacent peripheral edges 12. Each of the elongated holes 16 is formed inside by an interval D1 (for example, 3 mm) of about a thickness of the side plate 13 from the peripheral edge 12. Each elongated hole 16 has a predetermined length along the peripheral edge 12 and has a predetermined length D2 (for example, 15 mm to 40 mm) in an orthogonal direction to the peripheral edge 12. With such a configuration, when the bottom case 10 is assembled, each elongated hole 16 is formed inside by the interval D1 of the thickness of the side plate 13 from the peripheral edge 12.

The covering case 20 has: a substantially square-shaped top plate 21; and substantially square-shaped side plates 23 which are suspended from peripheral edges 22 of the top plate 21. At a position close to a lower edge of the side plate 23, a coupling hole 24 (a second coupling part) is opened corresponding to the coupling hole 14 of the bottom case 10 when the covering case 20 is fitted into the bottom case 10. Also, in the respective one of the side plates 23, a gripping hole or an opening in which an object packaged together with the packaged article is to be packed may be formed.

The joint 30 is inserted and engagingly locked with the coupling hole 14 that is formed in each side plate 13 of the bottom case 10 and the coupling hole 24 that is formed in each side plate 23 of the covering case 20 so as to thereby couple each side plate 13 of the bottom case 10 and each side plate 24 of the covering case 20 to each other. As the joint 30, for example, a hinge joint can be used.

Figure 3A:
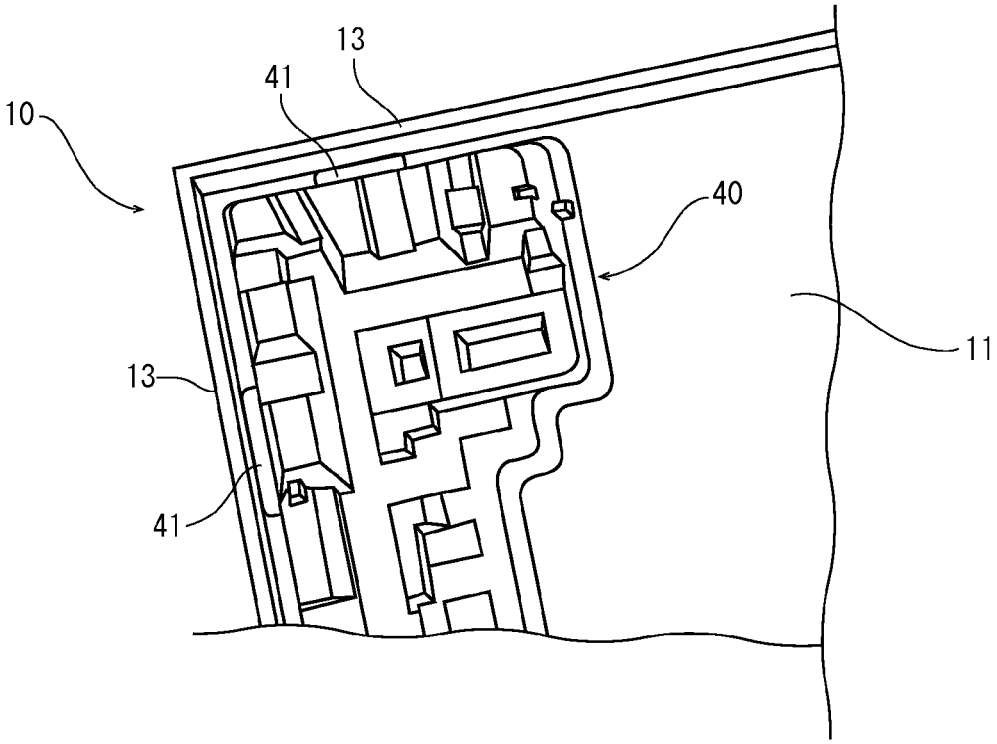
FIG. 3A is a perspective view showing a buffering member installed in the bottom case, viewed from the upper side, in the packaging box according to the first embodiment of the present disclosure.
Figure 3B:
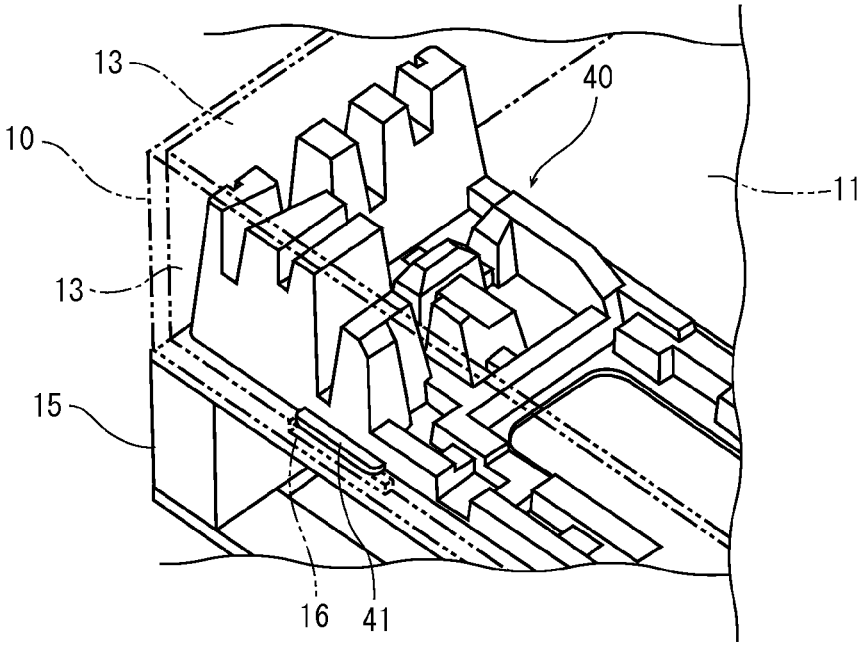
FIG. 3B is a perspective view showing the buffering member installed in the bottom case, viewed from the obliquely upward side, in the packaging box according to the first embodiment of the present disclosure.

As shown in FIG. 3A and FIG. 3B, the buffering member 40 is formed with protruding pieces 41 extending in a horizontal direction on the bottom plate 11 of the bottom case 10 toward the adjacent side plates 13 of the bottom case 10. By abutting each the protruding piece 41 against each side plate 13, each of the buffering members is positioned on the bottom plate 11 of the bottom case 10. Incidentally, FIG. 3B shows the bottom case 10 by the double-dotted chain line for easy understanding. Each protruding piece 41 is formed at a position corresponding to each elongated hole 16 formed in the bottom plate 11 when the buffering member 40 is positioned on the bottom plate 11 of the bottom case 10. Each protruding piece 41 has a length in the direction along the peripheral edge 12 of the bottom case 10 smaller than a length of the elongated hole 16 and a length in the orthogonal direction to the peripheral edge 12 larger than a thickness of the side plate 23 of the covering case 20. Therefore, if each protruding piece 41 abuts against each side plate 13, a gap which is wider than the thickness of the side plate 23 of the covering case 20 is formed between each buffering member 40 and each side plate 13. Incidentally, the shape of the buffering member 40 is appropriately changed according to the shape or strength of the packaged article. Also, an opening or a space may be formed in consideration of reduction of material costs or the like.

Figure 4A:
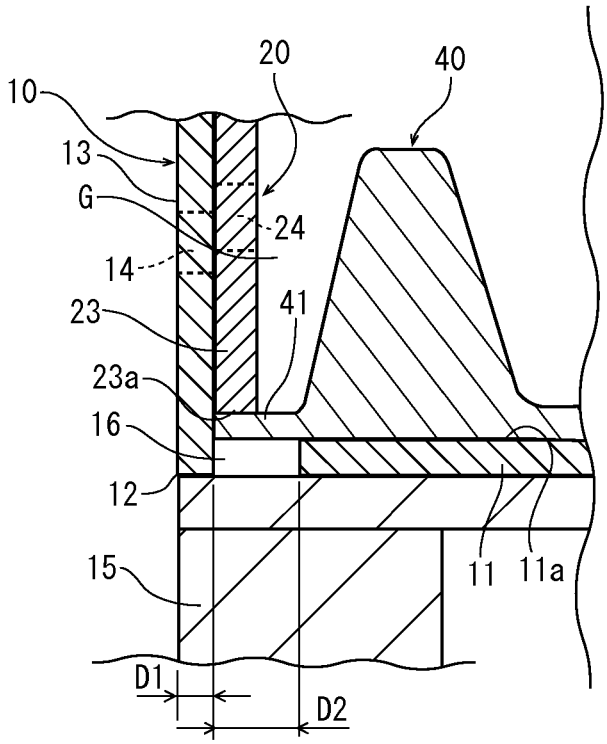
FIG. 4A is a side view showing a covering case in which a protruding piece of the buffering member abuts against a side plate, in the packaging box according to the first embodiment of the present disclosure.
Figure 4B:
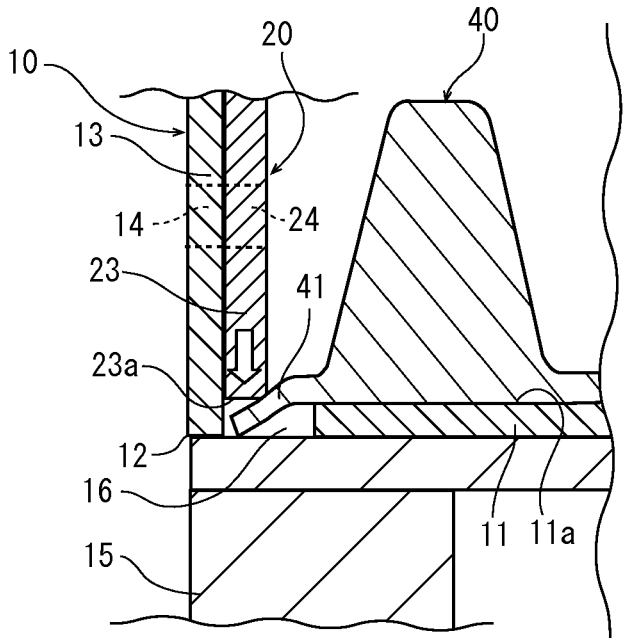
FIG. 4B is a side view showing the covering case in which the side plate is pressed downward, in the packaging box according to the first embodiment of the present disclosure.

A procedure for packaging an packaged article in the packaging box 1 having the configuration as mentioned above will be described with reference to FIG. 4A and FIG. 4B. First, on the bottom plate 11 of the bottom case 10, the pair of buffering members 40 is disposed oppositely each other. At this juncture, as shown in FIG. 4A, each protruding piece 41 of each buffering member 40 is caused to abut against each side plate 13 of the bottom case 10, and each buffering member 40 is therefore positioned on the bottom case 10. Then, each protruding piece 41 is positioned above the corresponding elongated hole 16 of the bottom plate 11 and a gap G of the length of each protruding piece 41 is formed between the buffering member 40 and each side plate 13. Next, on the bottom case 10, the packaged article is placed via the buffering members 40, and then the bottom case 10 is covered with the covering case 20. At this juncture, each side plate 23 of the covering case 20 is inserted into the gap between each side plate 13 and each buffering member 40 on the bottom case 10.

When each side plate 23 of the covering case 20 is inserted into the gap G, a lower edge 23*a* of each side plate 23 abuts against an upper face of the protruding piece 41 of each buffering member 40. In this state, since a gap of the thickness of the protruding piece 41 is formed between the lower edge 23*a* of each side plate 23 of the covering case 20 and the upper face 11*a* of the bottom plate 11 of the bottom case 10, the positions of the coupling hole 14 of the bottom case 10 and the coupling hole 24 of the covering case 20 are shifted to each other in a vertical direction. From this state, as indicated by the outlined arrow of FIG. 4B, if the covering case 20 is pressed downward, each protruding piece 41 is pressed by each side plate 23, is folded downward and then engages into each elongated hole 16 formed in the bottom plate 11 of the bottom case 10. Here, since the elongated hole 16 has a length in the direction along the peripheral edge 12 of the bottom plate 11 of the bottom case 10 larger than a length of the protruding piece 41 and a comparatively long length D2 in the orthogonal direction to the peripheral edge 12 of 15 mm to 40 mm, the protruding piece 41 is completely engaged into the elongated hole 16. Then, the lower edge 23*a* of each side plate 23 of the covering case 20 abuts against the upper face 11*a* of the bottom plate 11 of the bottom case 10 and, therefore, the positions of the coupling hole 14 of the bottom case 10 and the coupling hole 24 of the covering case 20 overlap each other in the vertical direction.

Lastly, the side plates 13, 23 are coupled to each other by inserting the joint 30 into the coupling holes 14, 24 that are respectively formed in the side plates 13, 23 of the bottom case 10 and the covering case 20, thereby coupling the bottom case 10 and the covering case 20 into the packaging box 1.

As has been described hereinabove, in the packaging box 1 according to the embodiment, even if the protruding piece 41 is formed for positioning of the buffering members 40, the covering case 20 can be inserted into the bottom case 10 without any interference with the protruding piece 41. That is, while positioning the buffering members 40 on the bottom case 10, the lower edge 23*a* of the side plate 23 of the covering case 20 is caused to abut against the upper face 11*a* of the bottom plate 11 of the bottom case 10 so that the coupling holes 14, 24 of the bottom case 10 and the covering case 20 can be precisely positioned, respectively. Therefore, the coupling work employing the joint 30 can be smoothly carried out.

In addition, although the elongated hole 16 is formed in the bottom plate 11 of the bottom case 10, since no portion to be compressed in the vertical direction is formed in the bottom case 10 and the covering case 20, a portion at which the compression strength in the vertical direction lowers is not produced. Therefore, the strength of the packaging box 1 can be ensured. Further, since the protruding piece 41 of the buffering member 40 is folded by the work of inserting the covering case 20 into the bottom case 10, a specific work for folding the protruding piece 41 is not required and the workability at the packaging does not lower.

Next, with reference to FIG. 5A and FIG. 5B, a packaging box according to a second embodiment will be described. In the embodiment, in order to house the protruding piece 41 of the buffering member 40, in place of the elongated hole 16, a depression 17 is formed in the upper face 11*a* of the bottom plate 11 of the bottom case 10. The depression 17 is formed by compressing the top face 11*a* of the bottom plate 11 downward by a pressing die so as to have a depth of about the thickness of the protruding piece 41.

Figure 5A:
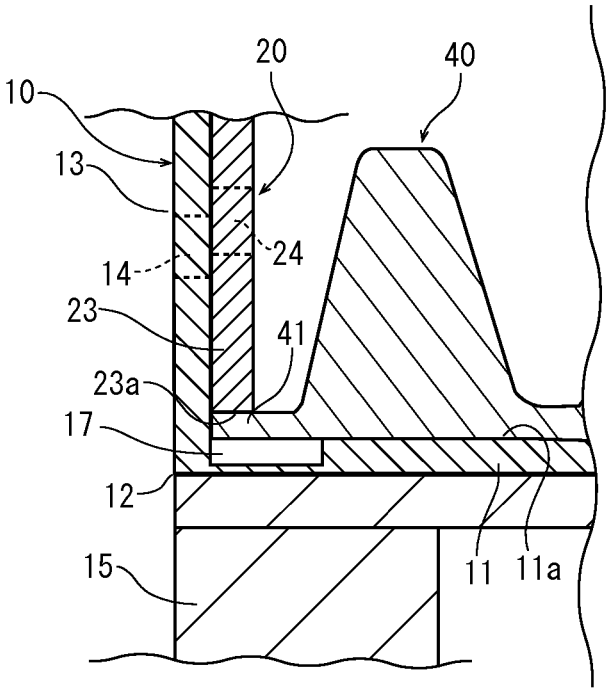
FIG. 5A is a side view showing the covering case in which a protruding piece of the buffering member abuts against the side plate, in a packaging box according to a second embodiment of the present disclosure.
Figure 5B:
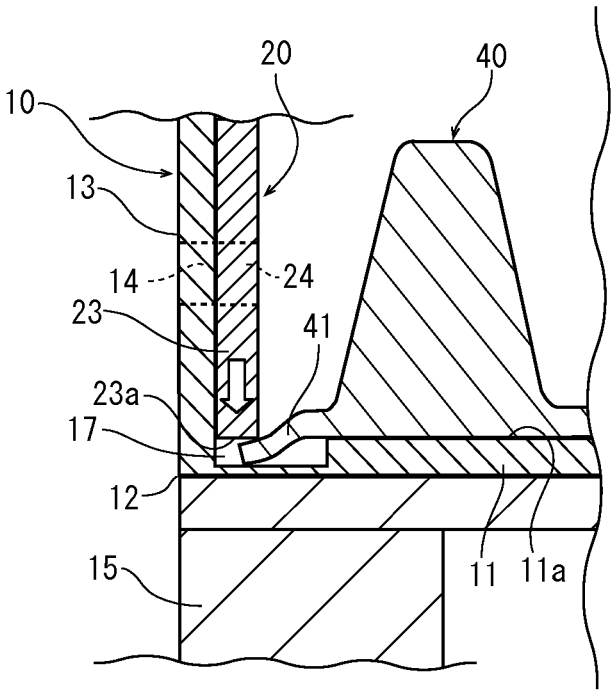
FIG. 5B is a side view showing the covering case in which the side plate is pressed downward, in the packaging box according to the second embodiment of the present disclosure.
Figure 6A:
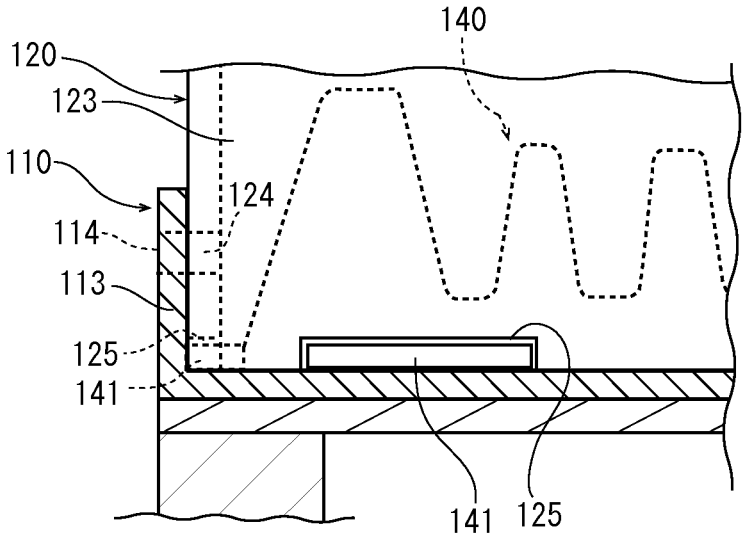
FIG.6A Related Art
FIG. 6A is a side view showing a structure of a lower part of a conventional separate type packaging box.
Figure 6B:
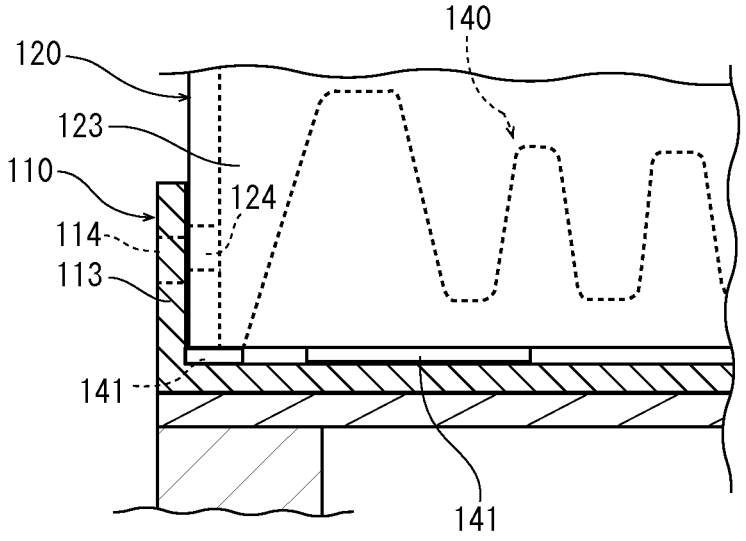
FIG.6B Related Art
FIG. 6B is a side view showing another structure of the lower part of a conventional separate type packaging box.

In the embodiment as well, as shown in FIG. 5A, when the lower edge 23*a* of each side plate 23 of the covering case 20 is caused to abut against the upper face of the protruding piece 41 of each buffering member 40 and then, as shown in FIG. 5B, the covering case 20 is pressed downward, each protruding piece 41 is pressed by each side plate 23, is folded downward and then engages into each depression 17 formed in the bottom plate 11 of the bottom case 10. Then, the lower edge 23*a* of each side plate 23 of the covering case 20 abuts against the upper face 11*a* of the bottom plate 11 of the bottom case 10.

By employing the depression 17 as a space in which the protruding piece 41 of the buffering member 40 is to be housed, an opening is not formed in the bottom plate 11. This makes it possible to prevent intrusion of dust or the like into the packaging box 1, and, therefore, is preferred in particular for a packaging box not provided with the pallet 15.

In addition, in the buffering member 40, in order to easily fold the protruding piece 1, the protruding piece 41 may be formed via a fold line or a connecting part with its low strength.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A packaging box comprising:

a bottom case having a bottom plate and a side plate erected from a peripheral edge of the bottom plate, a first coupling part being formed in the side plate;

a covering case having a top plate and a side plate suspended from a peripheral edge of the top plate, a second coupling part being formed at a position corresponding to the first coupling part of the side plate; and a buffering member disposed around a packaged article on the bottom plate, the packaging box being configured by inserting the side plate of the covering case inside the side plate of the bottom case and then coupling the first coupling part and the second coupling part to each other by a joint, wherein the buffering member is formed with a protruding piece protruded on the bottom plate in a direction from the buffering member to the side plate of the bottom case, in which by causing the protruding piece to abut against the side plate of the bottom case, a gap into which the side plate of the covering case can be inserted is formed with respect to the side plate of the bottom case, the bottom plate is formed with a space in which the protruding piece can be housed, at a position corresponding to the protruding piece of the buffering member, and when the side plate of the covering case is inserted inside the side plate of the bottom case, the protruding piece of the buffering member is pressed by the side plate of the covering case and then folded to be housed in the space.

2. The packaging box according to claim 1, wherein the bottom case is provided with a pallet on an under face of the bottom plate.

3. The packaging box according to claim 1, wherein the space formed in the bottom plate is a hole penetrating the bottom plate or a depression formed on an upper face of the bottom plate.

4. A packaging box comprising:

a bottom case having a bottom plate and a side plate erected from a peripheral edge of the bottom plate, a first coupling part being formed in the side plate;

a covering case having a top plate and a side plate suspended from a peripheral edge of the top plate, a second coupling part being formed at a position corresponding to the first coupling part of the side plate; and a buffering member disposed around a packaged article on the bottom plate, the packaging box being configured by inserting the side plate of the covering case inside the side plate of the bottom case and then coupling the first coupling part and the second coupling part to each other by a joint, wherein the buffering member is formed with a protruding piece protruded on the bottom plate in a direction from the buffering member to the side plate of the bottom case, in which by causing the protruding piece to abut against the side plate of the bottom case, a gap into which the side plate of the covering case can be inserted is formed with respect to the side plate of the bottom case, the bottom plate is formed with at least one space in which the protruding piece can be housed, at a position corresponding to the protruding piece of the buffering member, and when the side plate of the covering case is inserted inside the side plate of the bottom case, the protruding piece of the buffering member is pressed by the side plate of the covering case and then folded to be housed in the at least one space, wherein the at least one space comprises a plurality of spaces being formed along each of adjacent peripheral edges at each of four corners of the bottom plate.

5. The packaging box according to claim 1, wherein when the protruding piece of the buffering member is pressed and folded by the side plate of the covering case and then to be housed in the space, a lower edge of the side plate of the covering case abuts against the upper face of the bottom plate of the bottom case.

* * * * *